US010269334B2

(12) United States Patent
Spinazzola

(10) Patent No.: US 10,269,334 B2
(45) Date of Patent: Apr. 23, 2019

(54) ONE TOUCH DRUM TUNING SYSTEM

(71) Applicant: David Michael Spinazzola, Sammamish, WA (US)

(72) Inventor: David Michael Spinazzola, Sammamish, WA (US)

( * ) Notice: Subject to any disclaimer, the term of this patent is extended or adjusted under 35 U.S.C. 154(b) by 0 days.

(21) Appl. No.: 15/616,854

(22) Filed: Jun. 7, 2017

(65) Prior Publication Data

US 2017/0270900 A1 Sep. 21, 2017

Related U.S. Application Data

(63) Continuation of application No. 15/075,969, filed on Mar. 21, 2016, now abandoned, which is a continuation of application No. 14/541,783, filed on Nov. 14, 2014, now abandoned, which is a continuation of application No. 13/891,090, filed on May 9, 2013, now Pat. No. 9,053,685, and a continuation of application No. 13/890,189, filed on May 8, 2013, now Pat. No. 8,912,416.

(60) Provisional application No. 61/645,337, filed on May 10, 2012.

(51) Int. Cl.
*G10D 13/02* (2006.01)

(52) U.S. Cl.
CPC ..... *G10D 13/023* (2013.01); *G10D 13/028* (2013.01)

(58) Field of Classification Search
CPC ..... G10D 13/023; G10D 13/028
See application file for complete search history.

(56) References Cited

U.S. PATENT DOCUMENTS 816,754 A * 4/1906 Soistmann ..... G10D 13/023 84/411 R
1,031,032 A * 7/1912 Wanamaker ..... G10D 13/023 84/411 R
1,451,289 A * 4/1923 Christian ..... G10D 13/023 84/411 R
1,901,765 A * 3/1933 Newberry ..... G10D 13/023 84/411 R
2,706,925 A * 4/1955 Fendlason, Sr. ..... G10D 13/023 84/413
3,439,573 A * 4/1969 Zottolo ..... G10D 13/023 84/411 R
4,079,657 A * 3/1978 Sobreira ..... G10D 13/023 84/411 A
4,714,002 A * 12/1987 Cleland ..... G10D 13/02 84/413

(Continued)

*Primary Examiner* — Robert W Horn
(74) *Attorney, Agent, or Firm* — Foster Pepper PLLC

(57) ABSTRACT

A cam operated drum tuning system which is rotatable clockwise and counterclockwise to tunes a musical drum. A cam ring mechanism employs multiple helical tracks. A removable radius plate and tool facilitates rotation. The timing system may be attached directly to drum lugs, to a retrofit ring attached to the lugs, or to a full floating I or II framework which use edge or full floater rings, and/or adjustable pull rods to connect the top and/or bottom tuning systems so that nothing need contact the drum shell. Eccentric micro tuners adjust the rim rollers which ride on the inner hoop, which has a lip on the underside to add overlap. Elevators are fused to raise and/or lower the cam ring to align it perpendicular to the bearing edge of the drum shell.

13 Claims, 16 Drawing Sheets

(56) References Cited

U.S. PATENT DOCUMENTS

| | | | | | |
|---|---|---|---|---|---|
| 4,909,125 | A * | 3/1990 | Fece | G10D 13/023 | 84/411 A |
| 5,447,087 | A * | 9/1995 | Hawes | G10D 13/02 | 84/413 |
| 5,739,448 | A * | 4/1998 | Toscano | G10D 13/023 | 84/411 A |
| 5,977,463 | A * | 11/1999 | Bartlett | G10D 13/023 | 84/413 |
| 6,365,811 | B1 * | 4/2002 | Conta | G10D 13/023 | 84/411 A |
| 6,417,432 | B1 * | 7/2002 | Downing | G10D 13/023 | 84/411 A |
| 7,138,574 | B1 * | 11/2006 | Spinazzola | G10D 13/023 | 84/411 R |
| 7,501,567 | B1 * | 3/2009 | Spinazzola | G10D 13/023 | 84/411 R |
| 8,642,867 | B1 * | 2/2014 | Bedson | G10D 13/023 | 84/413 |
| 8,912,416 | B2 * | 12/2014 | Spinazzola | G10D 13/028 | 84/413 |
| 9,006,548 | B2 * | 4/2015 | Bedson | G10D 13/023 | 84/413 |
| 9,053,685 | B2 * | 6/2015 | Spinazzola | G10D 13/028 | |
| 9,390,693 | B2 * | 7/2016 | Kasha | G10D 13/00 | |
| 9,613,602 | B2 * | 4/2017 | Welch | G10D 13/023 | |
| 9,653,052 | B2 * | 5/2017 | Bedson | G10D 13/023 | |
| 9,767,773 | B2 * | 9/2017 | Bedson | G10D 13/023 | |
| 2014/0026732 | A1 * | 1/2014 | Spinazzola | G10D 13/028 | 84/413 |
| 2017/0249929 | A1 * | 8/2017 | Bedson | G10D 13/023 | |
| 2017/0270900 | A1 * | 9/2017 | Spinazzola | G10D 13/028 | |

* cited by examiner

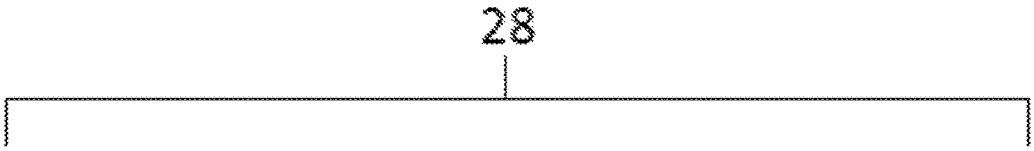
FIG. 11A
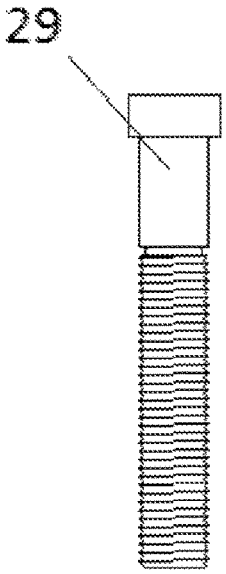
FIG. 11B
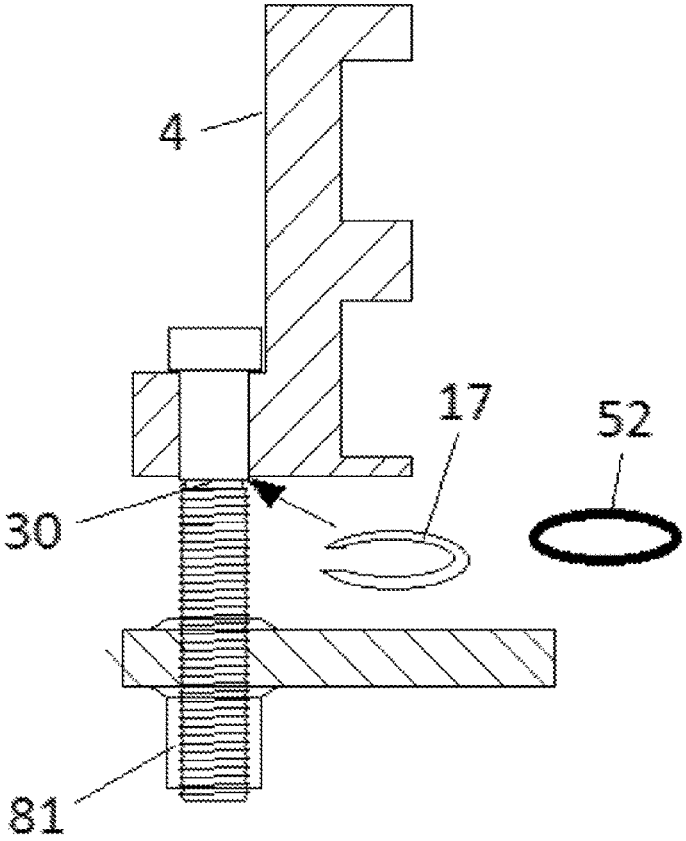

FIG. 13A
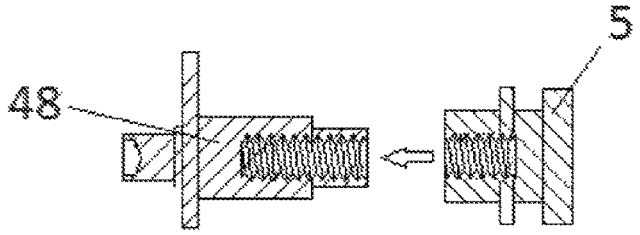
FIG. 13B
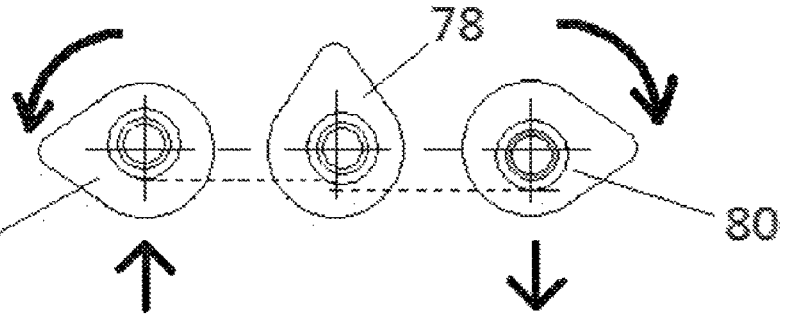
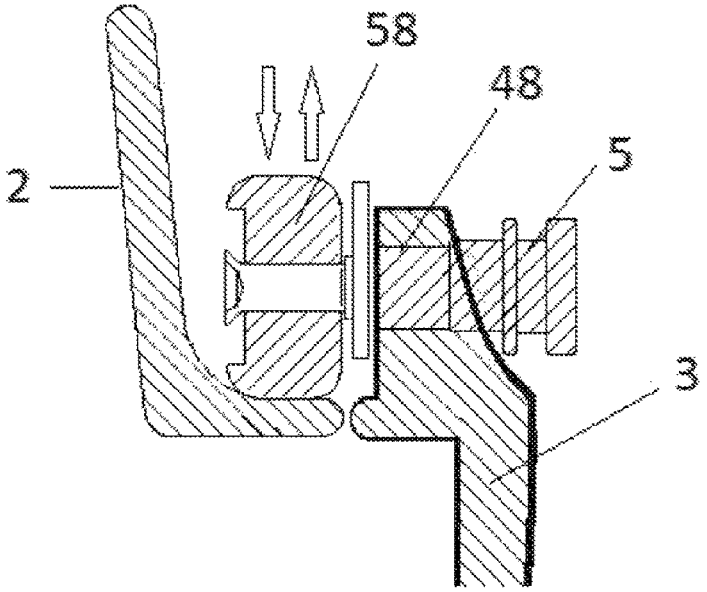
FIG. 13C

11

ONE TOUCH DRUM TUNING SYSTEM

PRIORITY CLAIM

This application is a continuation of U.S. patent application Ser. No. 14/541,783 entitled "ONE TOUCH DRUM TUNING SYSTEM" filed Nov. 14, 2014; this application also claims the benefit of the filing date of U.S. Patent Application No. 61/645,337, filed May 10, 2012, entitled "ROTATION ACTIVATED ACOUSTIC DRUM TUNING SYSTEM," U.S. patent application Ser. No. 13/890,189, filed May 8, 2013, entitled "ONE TOUCH DRUM TUNING SYSTEM," and U.S. patent application Ser. No. 13/891,090, filed May 9, 2013, entitled "ONE TOUCH DRUM TUNING COMPONENTS," each of which are hereby incorporated by reference in their entirety.

BACKGROUND OF THE INVENTION

Embodiments of the present invention relate to a not and/or useful system and apparatus for tuning any acoustic drum. Drums are comprised of several simple components including a drum head, most commonly made of a plastic material called Mylar, which include a rigid rim, generally made of a metallic material. The drum shell; most often made of layers of laminated wood, acrylic, aluminum, fiberglass or carbon fiber and/or formed to a cylindrical shape with two open ends. The drum head is stretched over the drum shell by means of a multiplicity of evenly spaced bolts inserted through holes around the diameter of a ring often made of stamped steel, die cast zinc, aluminum or wood known as the hoop. These bolts are threaded into what are commonly referred to as lugs which are generally attached to the drum shell by bolts inserted through holes drilled into the drum shell. Evenly adjusting the tension of these individual bolts causes the drum head to be tuned either higher or lower in pitch.

The current and/or most commonly used standard far tuning drums is best depicted by U.S. Design Pat. No. Fuji D350,362, incorporated by reference herein. Referred to as the drum hoop, it includes a plurality of evenly spaced holes for bolts to be inserted through, in order to exert tension on the drum head, and having an overall shape designed to fit over the drum head. U.S. Design Pat. No. D339,818, incorporated by reference herein, is an example of lugs which are fastened to the drum shell and/or serve as anchors for the bolts inserted through the drum hoop previously described. Some of the earliest designs of this current hoop can be seen in U.S. Pat. No. 794,658 dated Jul. 11, 1905, incorporated by reference herein, which depicts a combination of L cross section or "angle iron" rings, one with the vertical with surface facing upward, the other overlapping the horizontal surface and/or its vertical surface facing downward with holes about the horizontal flange for clamping down the drumhead. Similarly, U.S. Pat. No. 899,488 dated Sep. 22, 1908 has an inverted U shaped Cross Section with evenly spaced holes around its perimeter. One of the first early modern designs is shown in U.S. Pat. No. 1,609,940 dated Dec. 7, 1926, which appears to feature a one piece counterhoop having an "L" cross section, the horizontal flange having evenly spaced holes for clamping the drum head to the open end of the drum shell. U.S. Pat. No. 6,166,311 describes an invention that was designed as an improvement to the traditional drum hoop, having an inward facing horizontal annular surface at the top of the hoop that provides protection to the bearing edge of the drum shell, and also increases rigidity of the drum hoop.

Using traditional drum hoops and methods, to evenly apply tension to the drum head to set the correct pitch takes a great amount of time and skill, often being time consuming and frustrating. To deal with this problem, systems for tuning drums have been proposed simplify this common task. For example, U.S. Pat. No. 4,218,952 is comprised of a large counter-hoop with a plurality of inward facing slides angled to act as ramps which ride on rollers or matching opposing slides fastened to the drum shell. It is tuned by rotating the counter-hoop clockwise or counterclockwise using a rack and pinion activation system. U.S. Pat. No. 5,739,448 is comprised of an inverted J-shaped counter-hoop, which engages an externally threaded, outwardly facing tuning rim surface on a tuning collar that is secured to the drum shell. Clockwise or counterclockwise rotation, of the counter-hoop is accomplished by a pair of gears, one for gross tuning, and/or one for fine timing.

US Patent describes the undersigned inventor's improvement over U.S. Pat. No. 4,218,952. The system and apparatus described U.S. Pat. No. 6,043,419 utilizes a V Clamping mechanism which engages a counter-hoop which has a downwardly and outwardly extending flange which bears on the drum head and a flanged ring fastened to the drum shell, its flange portion inclined upwards and outwards. The V clamp ring surrounds the drum shell and engages the outwardly extending portions of the counter-hoop, and the shell hoop. The V hoop contains a breach, tightening a holt connecting the breached area draws the two hoops together and applies tension to the drum head.

U.S. Pat. No. 7,777,112 uses an outer ring attached to the drum shell with threads on the inner diameter. An inner ring which has a thread on the outside diameter engages the outer ring's threads. A lower inner ring which is separated by ball bearings rides on the rim of the drum head. Rotating the inner ring increases or decreases the tension on the drum head.

The present applicant's first solution to simplifying tuning was described in U.S. Pat. No. 7,138,574, incorporated by reference herein. This '574 drum tuning system is comprised of three annular members o-rings. The first annular member is the cam ring which utilizes a single spiraling track or helical around its outside diameter starting at the top of the spiral cam ring spiraling down and exiting at the bottom and is fastened to the cylindrical drum shell in the vicinity near the opened end of the drum shell. The second ring is a smaller inner counter-hoop having vertical and horizontal surfaces which form an L cross section. The third ring is a larger outer rotating actuator ring has inward lacing horizontal surface atop the vertical surface forming an inverted L cross section and encompasses the spiral can ring parallel to the spiral track or helical at its outside diameter. Inward facing rollers or wheels mounted on its vertical surface of the inside diameter engages the track or helical of the cam ring. The rotating actuator's inverted L cross section overlaps the L cross section of the inner counter-hoop, and the two rings are separated by bearings of rollers to reduce friction while twisting the rotating actuator ring clockwise or counterclockwise. The camming effect increases or decreases the downward force on the inner counter-hoop which bears down on the outer rim of the drum head when fitted over the open end of the drum shell, thereby tuning the drum.

Embodiments of the invention described in '574 mainly focused on certain mechanical aspects of altering the tension of a drum head efficiently and/or accurately.

The present applicant's second U.S. Pat. No. 7,501,567, incorporated by reference herein, had many improvements which included a method for attaching the tuning system to a drum shell and used eccentrics on the lugs to raise and/or lower the cam ring. Another improvement was the addition of a horizontal radius plate with holes for a drum stick to engage and/or be used as a leverage point stationary in relation to the drum shell. A tool was devised which hooked on "cleats" mounted on the lower vertical walls of the rotation actuator ring. A drum stick can be used for leverage against the tool while engaging the holes in the stationary radius plate and thereby facilitates movement of the rotating actuator ring, which in turn tunes the drum. The inner hoop and rotating actuator ring are completely separate. The rotating actuator ring has vertical bosses with inward facing rim rollers which ride on the horizontal surface of the inner hoop. A mounting system for mounting the drum in a stand used horizontal bolts and/or rubber grommets to allow for maximum resonance.

BRIEF DESCRIPTION OF THE DRAWINGS

FIG. 11A is a side view of the preferred embodiment of an elevator bolt which has a groove cut into the shaft in the vicinity below the head of the bolt.

FIG. 11B is a cross sectional view of the preferred embodiment of the elevator bolt inserted through a hole in the horizontal wall of the cam ring, with the circlip and/or O-Ring which are used to retain the bolt.

FIG. 13A is a side view of the eccentric micro-tuner rim roller axle shaft and/or cleat.

FIG. 13B is a front view of the eccentric micro-tuners at various adjustments, the one on the left with the roller raised, the one in the center with the roller in the neutral position, and/or the one to the right with the roller axle lowered.

FIG. 13C is a cross sectional view of an inner hoop, rotating actuator-ring, and/or the eccentric axle shaft micro-tuner and/or cleat.

DETAILED DESCRIPTION

Figure 1:
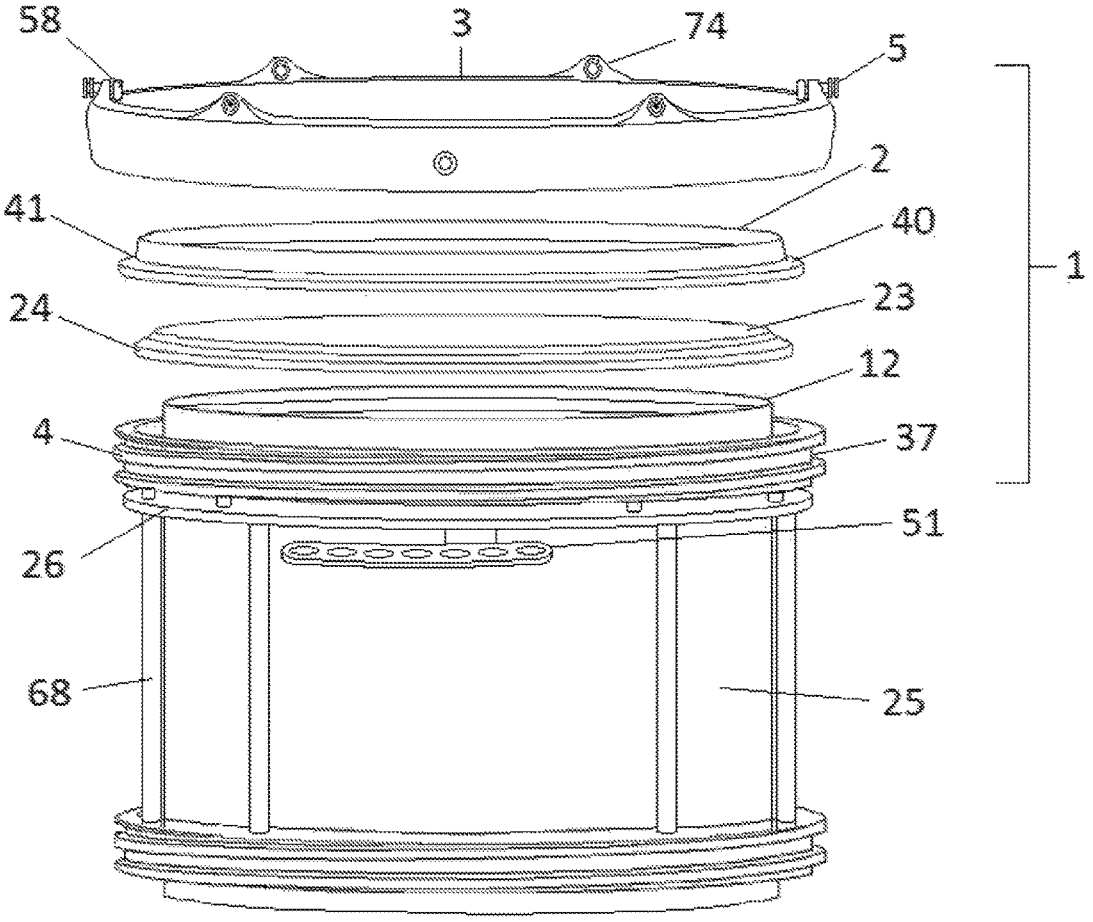
FIG. 1 is an exploded 3D view of a full floater II drum with a cam operated tuning system. From the top down is the rotator ring, inner hoop, drum head, bearing edge of the flange ring, cam ring, pull rods, drum shell and lower tuning system.

Embodiments of the present invention include, inter alia, further improvements made to the present applicants's U.S. Pat. Nos. 7,138,574 and 7,501,567, based upon real world testing with professional touring drummers and/or continued R&D. Embodiments of the present invention address several key issues, including, by way of example only: adaptability or retrofitting to existing, drums, adjustability range the ease of use, simplicity, and or aesthetics.

This drum tuning system provides the user an extremely simple means of replacing drum heads and/or tuning a drum. The following steps to install a drum head and/or tune the drum illustrate the simplicity of using this device. The drum head is fit over the open end of the drum shell, below the drum head is the cam ring which encircles the vicinity of the open end of the drum shell which has a helical, the inner counter-hoop is set on the drum head at its outermost circumference at the rim, then the rotating actuator is fit over and encompasses and overlaps the inner counter-hoop. By rotating it clockwise the inner facing rollers projecting from the vertical surface of its lower inside diameter engage the spiral cam rings' helical track or tracks and spins freely downward onto the inner counter-hoop until the upper inward facing rollers mounted on the vertical bosses engage the horizontal surface of the inner counter-hoop. Continued clockwise rotation of the rotating actuator against the inner counter hoop and/or helical cam ring applies downward force on the drum head at its rim, which increases the tension of the drum head membrane and thereby tunes the drum. Subsequent clockwise author counterclockwise movement of the rotating actuator raises or towers the tension of the drum bead to the desired tonal pitch.

Because certain mechanical aspects of altering the tension of the drum head by means of a cam mechanism were summarized in the "Background of the Invention" and in patents incorporated by reference, reference can be made to a "camming" mechanism throughout this application, and focus can be on the enhancements and additional features of various components. Anywhere in this application where "camming" mechanism is mentioned, the description of "camming" in the inventor's previous U.S. Pat. Nos. 7,138,574 and 7,501,567 is intended to supplement this application, and is incorporated by reference herein.

In one embodiment, the new tuning system changes the means of grasping the rotating actuator ring by moving the "cleats" from the lower vertical wall to the upper vertical bosses. This rearrangement reduces the number of parts reduces the machining costs, provides a cleaner look, and has the cleats double as nuts for the rim roller axles. The cleats' outward facing knob-like protrusions have a groove cross section to serve as an anchor point for a tool having a keyhole and/or a knob for users to grasp with their fingers and/or a drum stick for leverage. A removable plate (generally referred to as the radius grip plate) is inserted into a socket below the rotating actuator ring attached either to the camming mechanism or a full floater ring or edge ring. It protrudes out from the drum shell so that it can be used as a leverage point. This radius grip plate has a multiplicity of evenly spaced holes radially around the size of most people's fingers in it so that at least one of the radial cleats can generally be lined up with one of them. Because the new rotating actuator now has far fewer cleats than the previous one in U.S. Pat. No. 7,501,567, an offset removable design for the plate is preferred. A drum stick is generally used as a lever in conjunction with the keyhole tool when inserted into one of the holes in the radius grip plate to provide additional mechanical advantage over what a person's hand cart exert to turn the rotating actuator ring. As the rotating actuator ring is moved clockwise or counterclockwise, another hole lines up to engage the drum stick. Once the users run out of holes in the radial plate, they simply flip it over so as to make available more holes within reach of their fingers or drum stick for leverage. The removable offset grip plate may have a magnet to keep it from falling out accidentally.

In one embodiment, because the cleats were moved from the lower vertical surface to the upper vertical bosses, the new rotating actuator ring has wider and or thicker bosses for greater strength. The profile of the boss is preferably much more angular and/or rigid. In addition to the wider and/or thicker vertical bosses, the lower profile of the vertical wall is tapered, being thinner at the bottom and gradually thickening towards the middle and top of the rotating actuator ring. This dramatically reduces flex of the ring during tuning, while still minimizing mass. One by-product of these changes is generally preferable aesthetics.

To address potential quality control issues with drum heads or drum shells, in one embodiment eccentric micro tuning rim roller axles are attached to the vertical bosses on the rotating actuator ring. By turning the micro tuner clockwise or counterclockwise, the eccentric shape of the axle shaft moves the roller up or down with respect to the horizontal surface of inner hoop. Preferably, there is a neutral position in the center, one direction moves the roller down, the other moves the roller up thereby altering the tension at that location of the inner hoop and/or rotating actuator to distribute and equilibrate the tension on the drum head.

Due to the cylindrical shape of the drum shell and/or its relatively thin all thickness, the common belief is the less mass or surface area touching it, the better the resonance. Free floating drums do not have airy hardware touching the drum shell, and have been around for many years. This configuration is well known for having a very loud or "open" sound. The most common use of these free floating drums is marching band snare drums, and/or standard snare drums. Manufacturers such as Pearl Ludwig, Yamaha and Sleishman have made full floating drums for many years. U.S. Pat. No. 7,501,567 mentions a full floating drum with the cam operated tuning system installed on it due to the simplicity of the design and/or the popularity of it.

Since then, several additional means of installing the cam operated tuning system on these type of drums have been developed and/or tested with professional drummers. One of these systems is referred to as the "Full Floater I" which employs a cam operated tuning s stem on one end of the drum, usually the top or batter side, and a standard hoop on opposite side, generally the bottom side, it does not matter which side the tuning system is on, but for ease of use the top is generally preferred. The cam operated tuning system may be connected to the other standard hoop via intermediate ring, or full floater ring, and/or pull rods. When the cam operated tuning system is rotated clockwise or counterclockwise, the tension of both heads is simultaneously adjusted. The overall length of the framework or skeleton which includes the cam ring, pull rods and or drum hoop must be set so that there is sufficient adjustment range of the cam operated tuning system. The cam ring must also be perpendicular to the edge of the drum shell once it is installed. For this purpose elevators have been developed as a means of raising and/or lowering the cam ring. There are several options of "elevators". The first is a hollow tube nut with external threads used in conjunction with a shoulder bolt. The shoulder bolt is tightened down on the shoulder, and/or spinning the tube nut can adjust the cam ring up and/or down until perpendicular to the bearing edge of the drum shell. As the hollow nuts are rotated in the it ring or full floater ring, this raises and or lowers the cam ring. The second option employs a proprietary bolt which has a groove cut on the bolt's shaft below the head of the bolt. This bolt is installed through holes in the cam ring and/or a circlip is used to retain the bolt in the cam ring and/or allow the bolt to turn. By turning the bolt clockwise or counter clockwise, the cam ring is raised or lowered because the circlip contains the cam ring on the top and on the bottom, allowing the cam ring to be set perpendicular to the bearing edge of the drum shell.

The other full floating system is referred to as the "Full Floater II". This is because there are two cam operated tuning systems installed, one on either end of the open end of the drum shell. In order to isolate the tuning of the opposite tuning systems, a separate bearing edge is preferred. Full floating marching band drums use edge rings for this purpose, they have an L cross section with both vertical and/or horizontal walls. The cam operated timing system is attached to the edge rim on the horizontal flange, and/or the cam ring is adjusted to be perpendicular to the bearing edge of the ring. There is an additional set of holes in the horizontal surface for attaching the pull rods which connect the lower tuning system. These rods need to be adjustable so that the cam operated tuning system opposite the one mounted to the edge ring can be set perpendicular to the bearing edge of the drum shell once installed. The "Full Floater II" system's adjustable pull rod uses a shoulder bolt and/or hollow tube type nut to lengthen and/or shorten the overall the pull rod. Because of the differences in drum heads at the crown, fine tuning of the overall length of the pull rods and/or overall distance between the bearing edge of the drum shell and/or cam ring preferably should be set. This type of full floating system uses the edge ring or flange as the main anchor point for BOTH tuning systems. Having two completely separate tuning zones allows the drummer to set the tone to exactly what they want.

To facilitate installing the cam operated tuning system on existing drums, or lugs attached to the body of the drum shell, a method to do so was devised and is herein described. Elevators bolts retained by circlips are used to raise and/or lower the cam ring until it is preferably approximately perpendicular to the bearing, edge of the drum shell.

To further simplify the tuning of the drum and/or provide for greater tuning range, a new cam ring with multiple helical tracks around the outside perimeter of the cam ring was designed and is herein described. U.S. Pat. No. 7,138,574 described a single spiral helical track which starts at the top of the cam ring and/or exits at the bottom. The new cam ring described herein preferably has multiple helical tracks which start preferably at the top of the cam ring and exit at the bottom. The previous single helical cam ring generally requires the rotating actuator ring to be rotated until all of the inward facing cam rollers engage the track, and at that point tuning starts. The new cam ring allows for aligning the inward facing cam rollers on the rotating actuator ring with the multiple helical tracks, at the point tuning starts. The previous single helical cam ring is very progressive with a shallow pitch, the new multiple helical cam ring is steeper and/or tuning more immediate. This is meant to save the drummer time and/or provide for a greater tuning range because the ring need not be rotated as far before tuning may start. Also, as drum heads stretch out, the extra tuning range allows the drummer to use the heads longer. In addition, because the requirement to spin the rotating actuator is lessened to begin tuning, a shorter profile may be used to lessen mass.

To further aid in retrofitability and/or adjustability, a new inner hoop was developed which has a lip on the underside of its horizontal surface. This is intended to allow the drum head's rim to drop further down into the inside diameter of the cam ring. This is generally preferred because some drums' lugs are mounted very close to the beating edge of the drum body, which in turn raises the height of the cam ring in relation to the bearing edge of the drum body and thereby limits adjustment. This lip sort of "buys back" space to install the cam operated tuning system. In addition, it also allows for more adjustment range as the drum bead stretches and/or wears over time.

Figure 5:
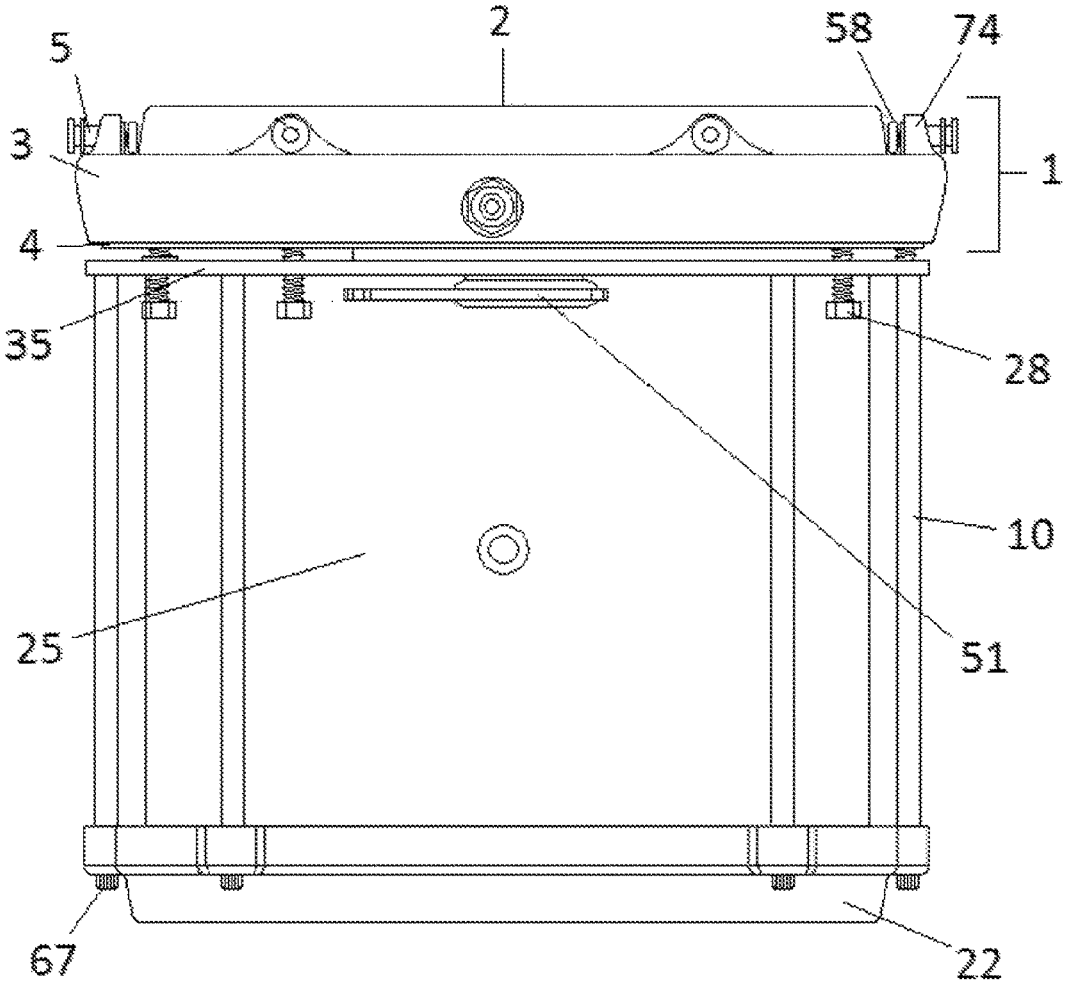
FIG. 5 is a detailed thawing of the full floater I drum with the cam operated tuning systems installed on the batter side of the drum connected via pull rods to the lower standard drum hoop.
Figure 6:
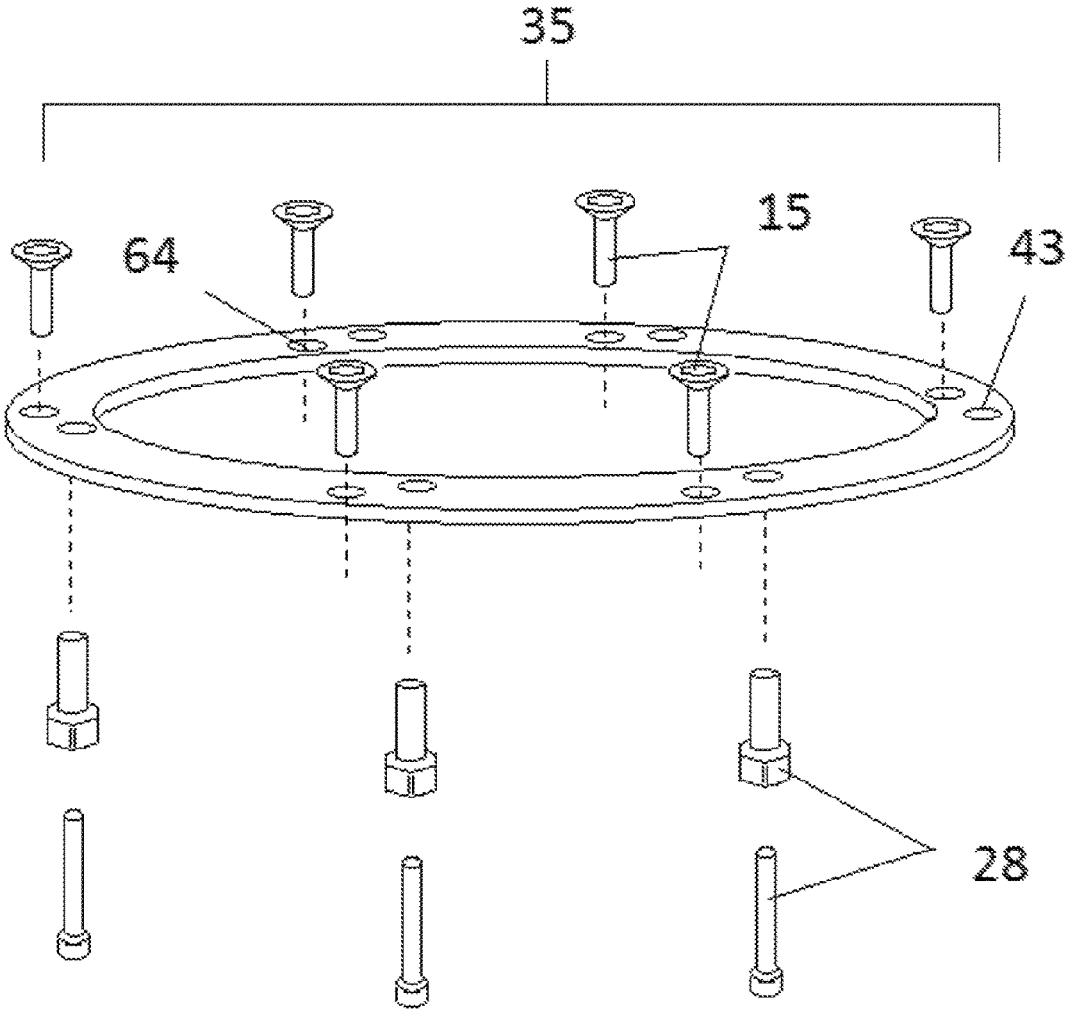
FIG. 6 is a 3D view of the full floater I ring, or flange ring, with bolts on top author elevators coming up from underneath.

The collective and individual embodiments of the inventions contained throughout this application effectively broaden the base of drum configurations that this cam operated drum tuning system, can be fit onto. Because the preferred embodiments of this tuning system does not rely on a multiplicity of tension rods to adjust the tension of the drum head, but rather a single clockwise or counterclockwise motion to tune the drum, the drum industry refers to this as a "One Touch Tuning System". Throughout this document, "one touch tuning system" is generally synonymous with "cam operated tuning system", or "tuning system". The different configurations where this tuning system is installed on a drum are depicted in the following drawings;

FIG. 5 is a Full floating I drum fitted with a cam operated tuning system.

Figure 7:
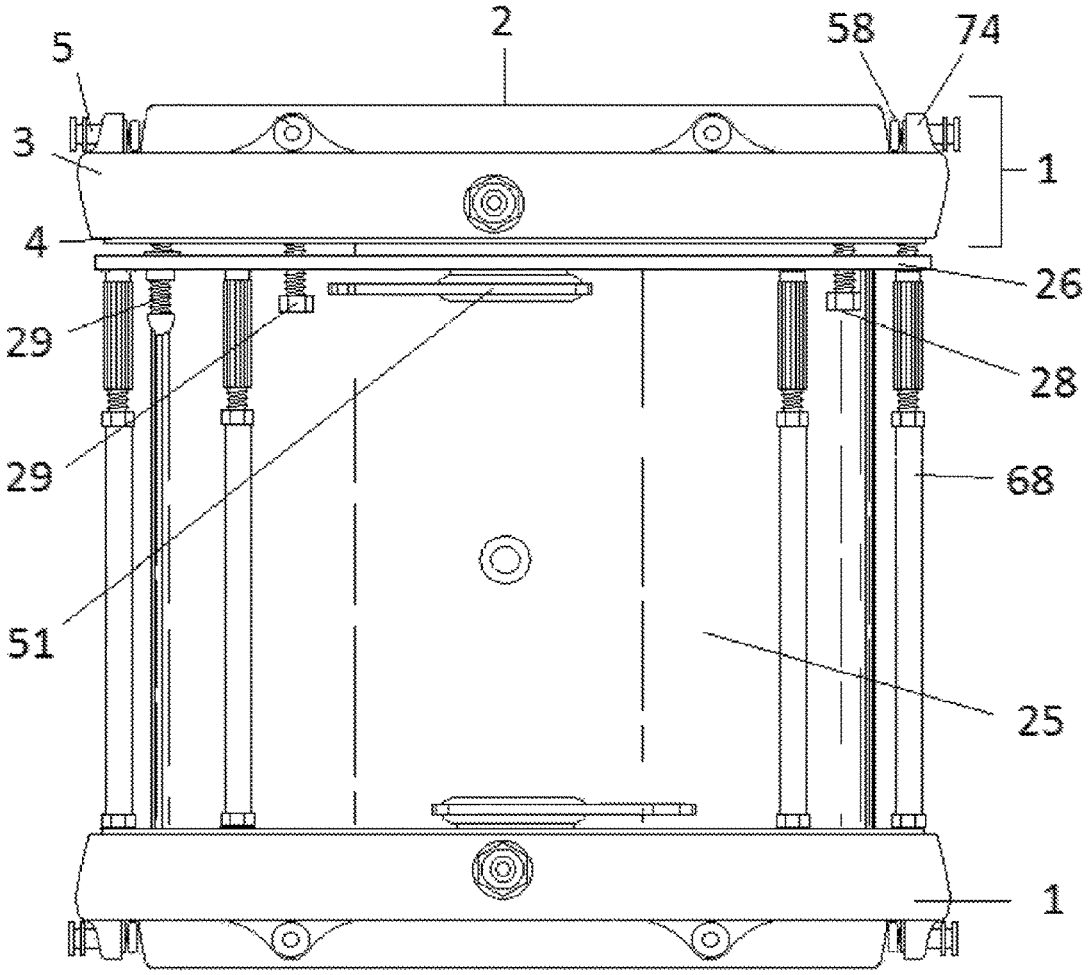
FIG. 7 is a detailed side view of the preferred embodiment of the full floater II drum with a cam operated tuning system on the top attached to a flange ring connected by adjustable pull rods to a lower cam operated tuning system which and/or a drum shell.

FIG. 7 is a Full Floating II drum fitted with a cam operated tuning system.

Figure 12:
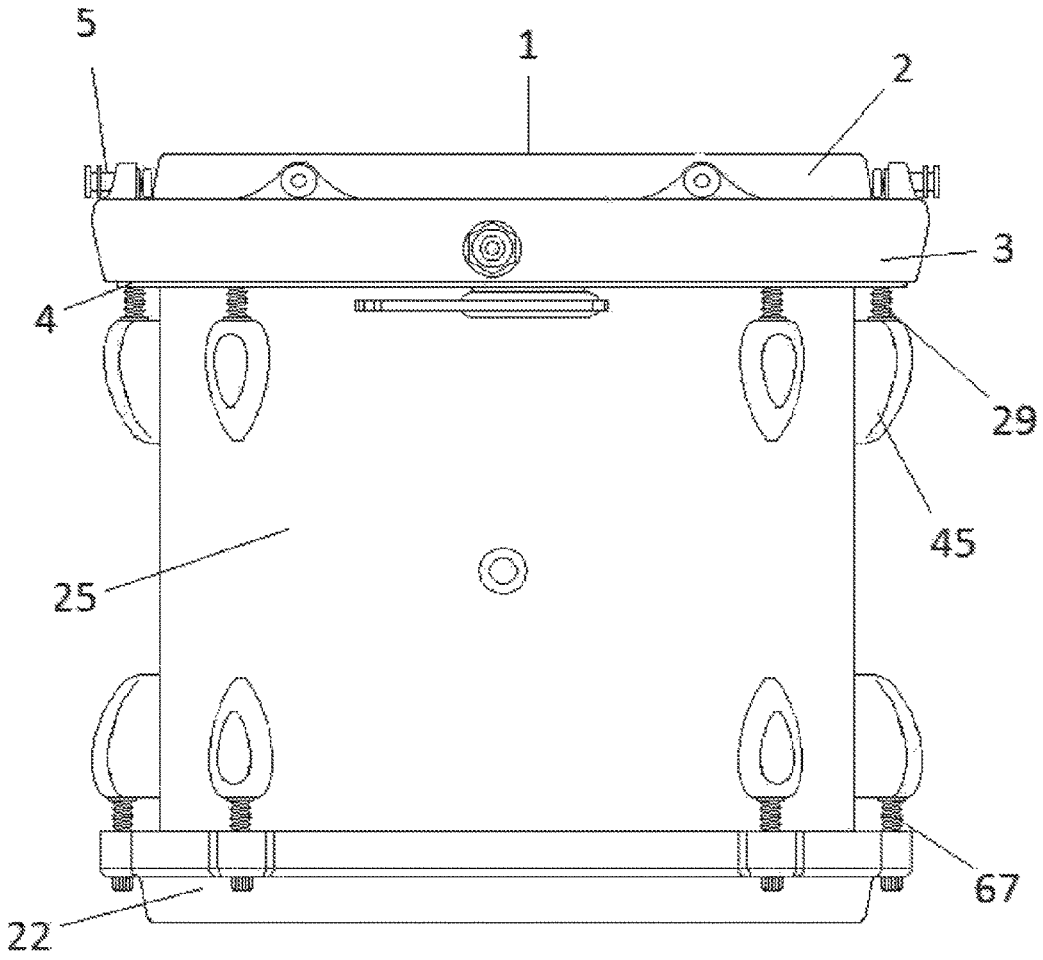
FIG. 12 is a detailed side view of the preferred embodiment of the cam operated dram tuning system fitted to huts on a standard drum using elevator bolts.

FIG. 12 is a Lugged drum fitted with a cam operated tuning system using elevators.

Along with these adaptations, improvements were made to all 3 annular members that make up the tuning system. The annular members or rings used in this tuning system are generally made of metallic materials such as aluminum or steel, but could also be made of other rigid materials such as plastic or carbon fiber, or the like. FIG. 1 is an exploded view of a drum and the components of the tuning system which include the Inner Hoop 2, Rotating Actuator ring 3, and the Cam Ring 4. These three components are shown in most of the drawings as complete assemblies and depending on the view will be identified in the drawings as they relate to the description.

Figure 2A:
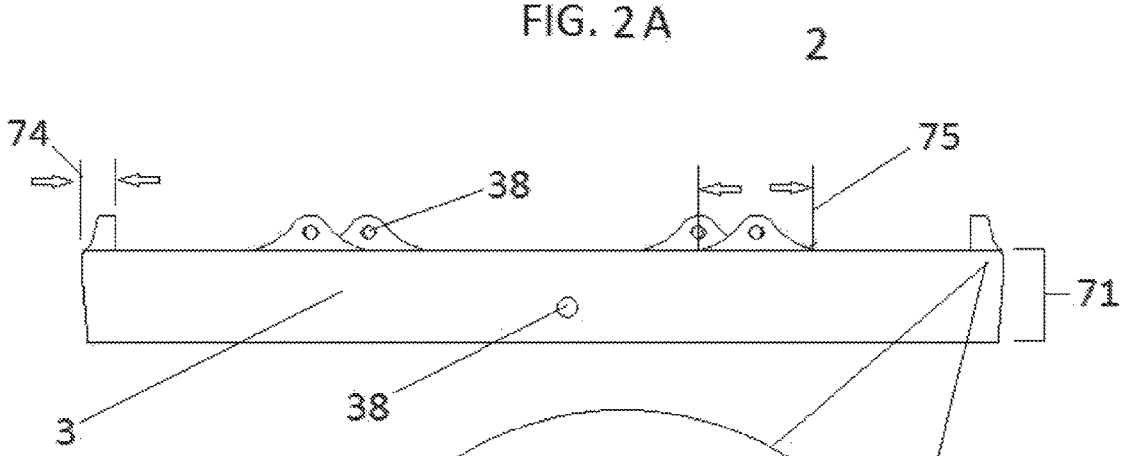
FIG. 2A is a side view of the preferred embodiment of the new rotating actuator ring.
Figure 2B:
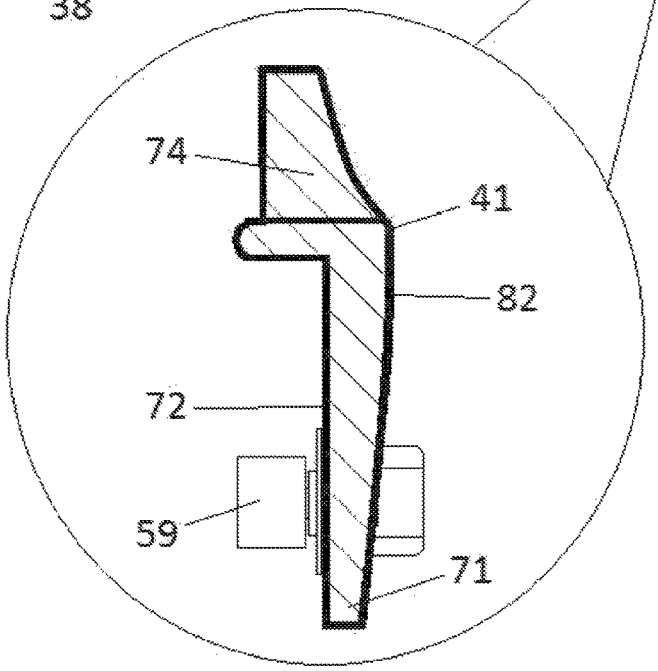
FIG. 2B is a magnified cross section view of the profile of the preferred embodiment of the rotating actuator ring.

FIG. 1 shows the components of the tuning system to aid in understanding how the system as a whole works. Though the tuning system is shown mounted on a full floating drum, it preferably functions in generally the same way on any type of drum configuration. In summary, preferred embodiments of the tuning system comprise a cam mechanism which functions by spinning the Rotating Actuator ring 3 clockwise or counterclockwise on the Cam Ring 4 and Inner Hoop 2 simultaneously. First, the Cam Ring 4 is fitted near the open end of the drum, shell 25, and a drum head 23 is placed over the drum shell's bearing edge 12. The Inner Hoop 2 sits on the rim of the drum head 24, and the Rotating Actuator 3 is brought down over the top of the Inner Hoop 2. Inward facing cam rollers (FIG. 2 reference character 59) on the lower vertical wall 72 of the Rotating Actuator ring 3 engage the Cam Ring's helical(s) 37 while the inward facing rim rollers 58 attached to the upper vertical bosses 71 on the Rotating Actuator ring 3 ride on the horizontal surface 40 of the Inner Hoop 2. As the cam rollers (FIG. 2 reference character 59) on the Rotating Actuator 3 descend the tracks or helical's 37 around the perimeter of the Cam Ring 4 during rotation, a camming action occurs and the rim rollers 58 attached to the upper vertical tabs 74 of the Rotating Actuator 3 apply pressure to the horizontal surface 40 of the Inner Hoop 2 which sits atop the rim of the drum head 24 and stretches the crown of the drum head over the bearing edge 12 of the drum shell 25, which tunes the drum. The Full Floater II drum framework as depicted in FIG. 1 shows the pull rods 68 which connect the flange ring's 26 horizontal axis near the top of the drum to the Cam Ring 4 on the bottom. The previously mentioned sequence can be followed for tuning the bottom or resonant side of the drum.

Preferably, the Rotating Actuator ring 3 is responsible for transferring the downward force created by the camming action during rotation directly to the Inner Hoop 2; it may also act as an interface for the drummer to tune the drum via rotation. Earlier versions of the Rotating Actuator ring displayed some torsional and/or linear flex under higher tensions, these being more evident as the size of the drum and/or the tuning system increased. In addition, the cleats which were previously mounted on the lower vertical wall of the Rotating Actuator caused some undesirable flex of the vertical wall. This occasionally affected the overall tunability of the drum. To address these problems, the preferred embodiment of the NEW Rotating Actuator ring FIGS. 2A & 2B was designed which solved some or all of the aforementioned issues. The NEW Rotating Actuator ring 3 has been thickened at the mid-section, giving it much more torsional and/or linear rigidity while remaining light and thin overall, while maintaining minimal mass. The cleats 5 have also been moved from the lower vertical wall 72 to the upper vertical bosses 74. Looking at the rotator rings profile 82 the cross section of the lower outer vertical wall 71 has a convex taper, thinner at the bottom and thicker where the vertical 72 and horizontal walls 41 connect near the center. The wall of the upper vertical boss 74 has a concave taper on the outside diameter, being thicker on the base and angling inward to thinner on the top. The vertical boss 74 is also much wider at the base along its horizontal wall 41 than the previous design, preferably tapering dramatically at the top like a pyramid. The vertical boss 74 is preferably substantially strengthened because the stresses are, higher due to both lateral load on the rim rollers, and longitudinal load at the cleat 5 during tuning. The result is a sufficiently rigid rotator ring 3 with minimal or non-detectable flex that offers dramatically smoother operation during rotation because instead of flexing under load, the ring remains rigid so tuning is more precise and consistent at all points about the circumference. The cleats 5 attached to the rim rollers 58 axles double as nuts, thereby reducing the separate number of parts overall to build the tuning system. The NEW look is far mote streamlined and simplified, and the form follows function.

Figure 3A:
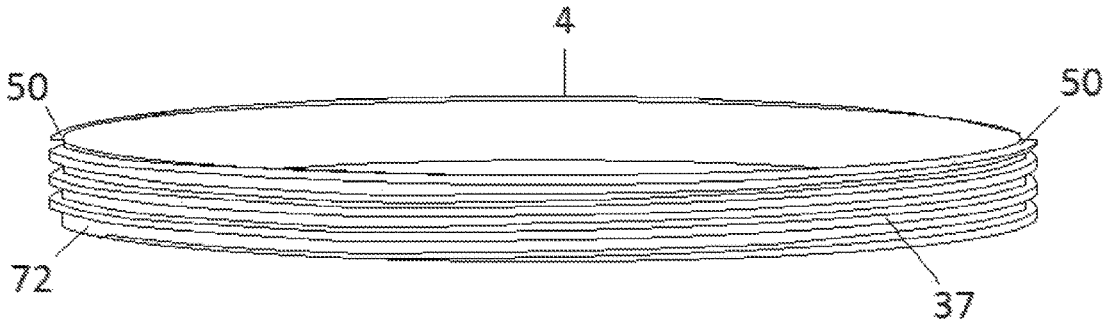
FIG. 3A is a 3D view of the preferred embodiment of the new cam ring shown with two leads.
Figure 3B:
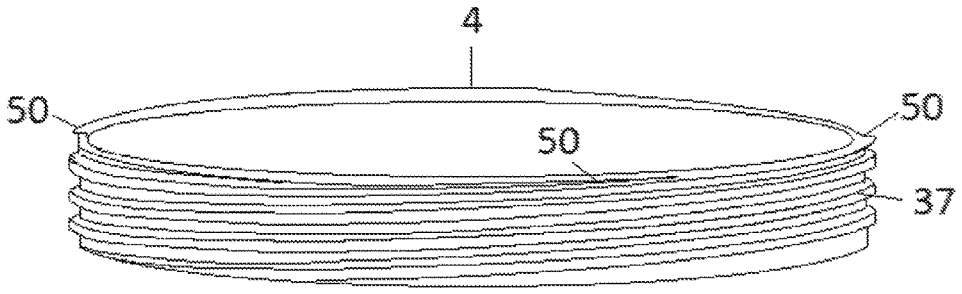
FIG. 3B is a perspective view of the preferred embodiment of the new cam ring shown with four leads.

A NEW Cam Ring FIGS. 3A & 3B was devised to better optimize the tuning system and/or allow for the maximum amount of adjustment from very slack tuning to extremely high. The preferred embodiment of the NEW Cam Ring employs multiple helical tracks 37 about the perimeter of the outside diameter of the Cam Ring 4 on its vertical surface 72. The increase in number of helical tracks 37 provides for a steeper pitch and thereby tunes the drum more quickly with less radial movement necessary. The helical's 37 function like the threads on a bolt but have multiple leads 50, or starting points rather than one. Advantageously, there is no wasted downward movement of the Rotating Actuator 3 because as soon as the multiple cam rollers 59 attached to the vertical wall of the Rotating Actuator 3 engage the leads 50 of the multiple helical tracks 37, timing may commence. The previous Cam Ring employed a single continuous helical track with a single lead so all of the inward facing varying height cam rollers FIG. 2 reference character 59 attached to the vertical wall of the Rotating Actuator 3 must engage the helical track. To picture this, if there were 3 equally spaced cam rollers, the Rotating Actuator would need to be "threaded on" a minimum of 240 degrees; the first at 0 degrees, the second at 120 degrees, and the third at 240 degrees to engage all of the rollers before tuning could commence. By contrast, with the multiple helical tracks 37 on the NEW Cam Ring 4, an equal number of cam rollers 59 protruding inward from the lower vertical wall 72 of the Rotating Actuator ring 3 would engage the matching multiple leads 50 of the helical track 37 simultaneously, so just a few degrees of engagement is necessary before tuning may commence. This results in much afore available rotational tuning adjustment range because there is no wasted rotation. At a minimum 240 degrees or more adjustment, there is also no concern of binding mechanically when the overlapping horizontal wall of the Rotating Actuator 3 meets the end of travel at the top of the Cam Ring 4. As the drum head stretches over time, this additional adjustment range allows drummers on a budget to save money by purchasing drum heads less often.

Figure 4A:
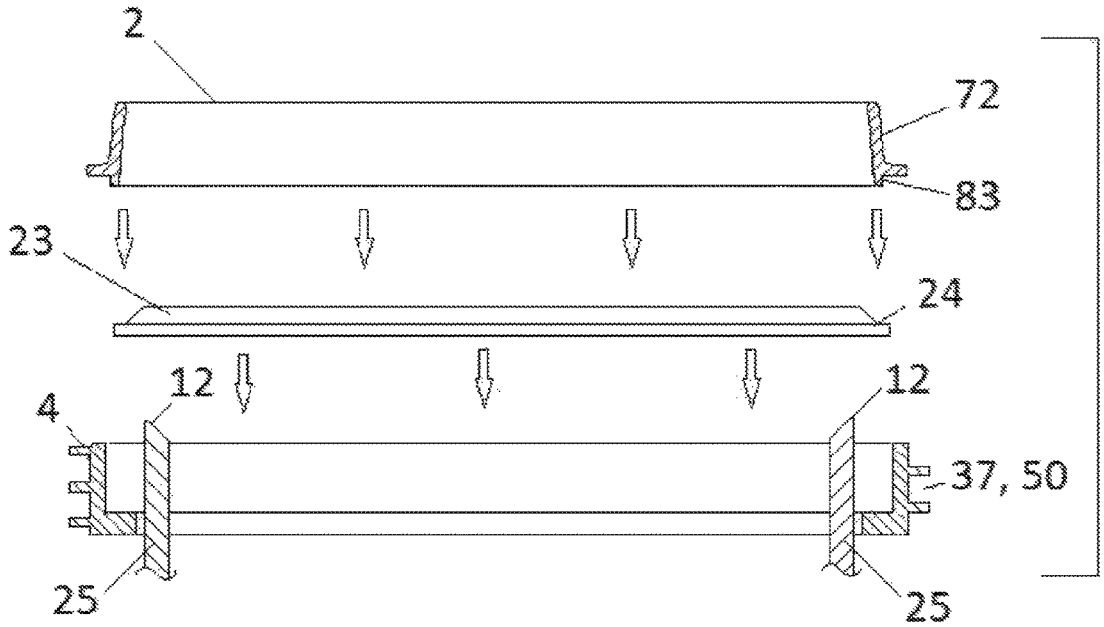
FIG. 4A is a exploded cross sectional view of the preferred embodiment of the new inner hoop, a drum head, the cam ring and for drum shell.
Figure 4B:
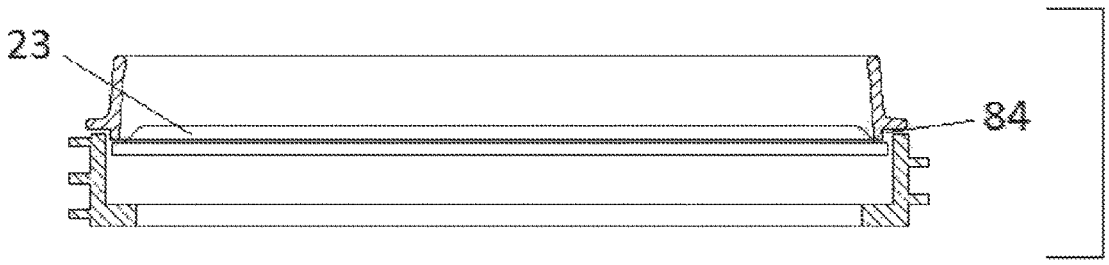
FIG. 4B is a cross sectional vim of the inner hoop, drum head and/or cam ring. The protrusion below the horizontal all of the inner hoop is shown overlapping the inside diameter of the cam ring.

A NEW Inner Hoop FIGS. 4A & 4B was devised for backward compatibility when retrofitting the one touch trilling system to existing drums. There are sometimes space issues because some drums have very little distance between the top of the lugs (FIG. 12 reference character 45) attached to the drum shell and/or the open end of the drum's bearing edge 12. To increase the range of drums which can be retrofitted with the tuning system, the preferred embodiment of the Inner Hoop was devised which adds a projection below the hoops' horizontal surface. The projection 83 allows for overlap between the bottom of the Inner Hoop 2 and the inside diameter of the Cam Ring 4. The drum head 23 is surrounded by the inside diameter of the Cam Ring 4, and previously, if the rim 24 of the drum head 23 was at the same height as the top of the Cam Ring 4, tuning was halted because the bottom of the Inner Hoop 2 would contact the top of the Cam Ring 4 and bind up the tuning system. The NEW Inner Hoops 2 downward facing projection 83 allows for the rim 24 of the drum head 23 to be even with or below the top of the Cam Ring 4. This allows for the Cam Ring 4 to be mounted closer to the open end of the drum shell's 25 beating edge 12 and fit drams with less space between the bearing edge 12 and the top of the lugs 45. This also allows for greater adjustment range because as the drum head 23 stretches at the crown, it can continue to stretch because the rim 24 of the drum head 23 can be below the top of the Cam Ring 4.

The Full Floater I drum FIG. 5 is comprised of a framework made up of a tuning system 1, horizontal flange 35, non-adjustable pull rods 10 which are solid or tubular containing female threads on both ends connected to a standard drum counter-hoop 22 at the opposite end. A tuning system 1 is connected via adjustable elevator bolts 28 to an intermediate flange 35 ring using one set of bolt holes 64 with a multiplicity of pull rods 10 connected to the second set of holes 43, which may or may not have the same bolt circle diameter. The opposite end of the pull rods 10 are connected by bolts to a standard drum hoop 22 which retains the drum head 23 and bolts 15 are firmly secured and preferably not used for adjustment purposes. The drum shell 25 is slipped through the framework until the bearing edge 12 is seated on the inner crown of the drum head 23 in the lower standard drum hoop 22. The second drum head 23 is placed over the open end of the drum shell 25 followed by the Inner Hoop 2 which sits on the rim of the drum head 24 and the Rotating Actuator 3 is placed over the Inner Hoop. Turning the Rotating Actuator engages the inward facing cam rollers (FIG. 2 reference character 59 attached to the lower vertical wall 72) into the inward facing Cam Ring 4 helical(s) or track(s) (FIG. 3A, 3B reference character 37) while the rollers 58 connected to the vertical bosses 74 contact the Inner Hoop's 2 horizontal surface. Continued clockwise and/or counterclockwise movement of the Rotating Actuator 3 raises and/or lowers the pitch of the drum. This simple-to-use embodiment does not require separate tuning of the opposing ends of the drum, instead, moving the tuning systems Rotating Actuator ring 3 clockwise simultaneously raises the pitch of the drum at both ends, likewise moving the Rotating Actuator ring 3 counterclockwise lowers the pitch of the drum at both ends.

Figure 8:
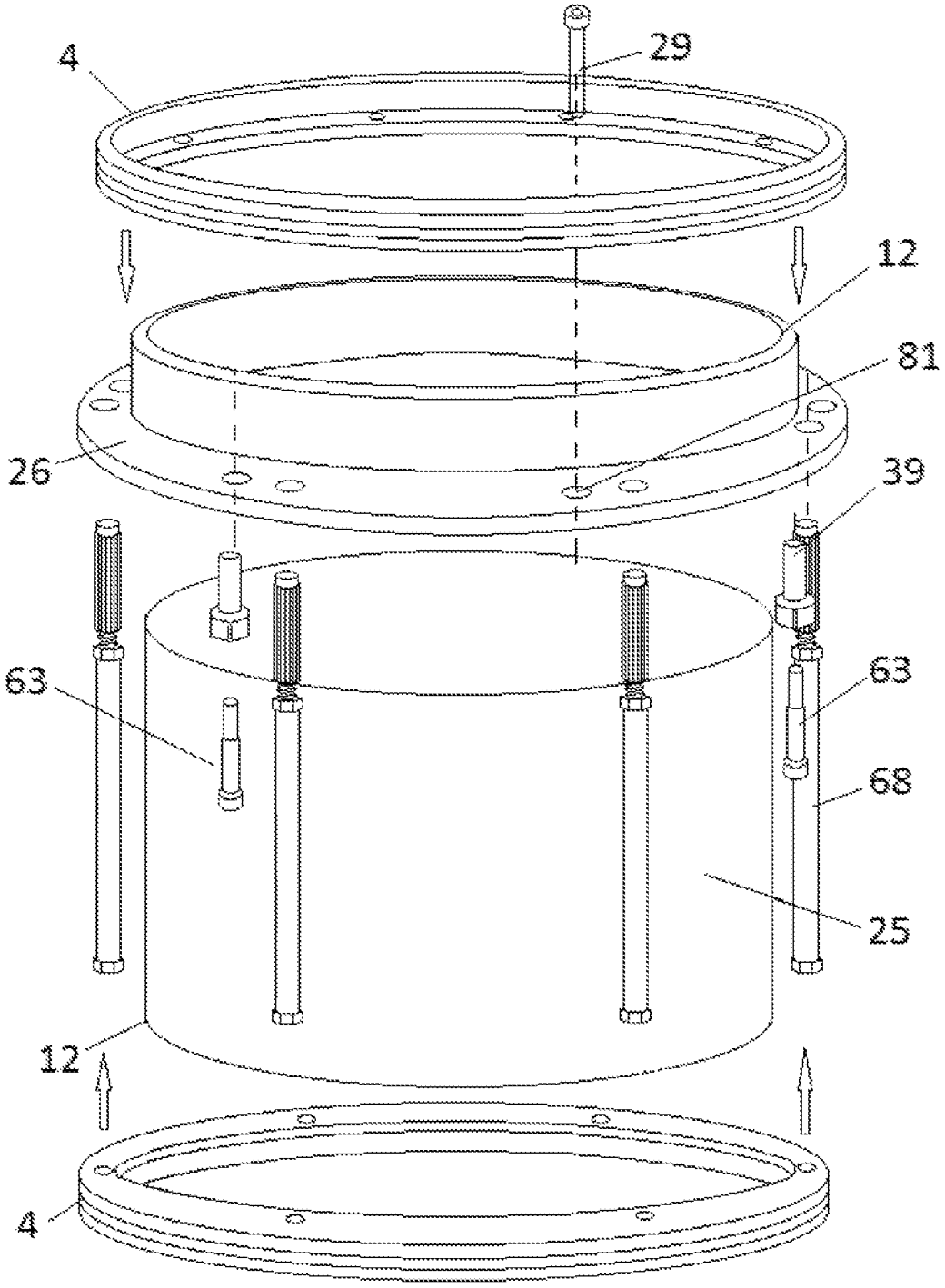
FIG. 8 is an exploded 3D view of the preferred embodiment of the framework for a full floater II drum. From the top is the cam ring, the flange ring, multiple adjustable pull rods, a drum shell and/or the lower cam ring.
Figures 10A, 10B:
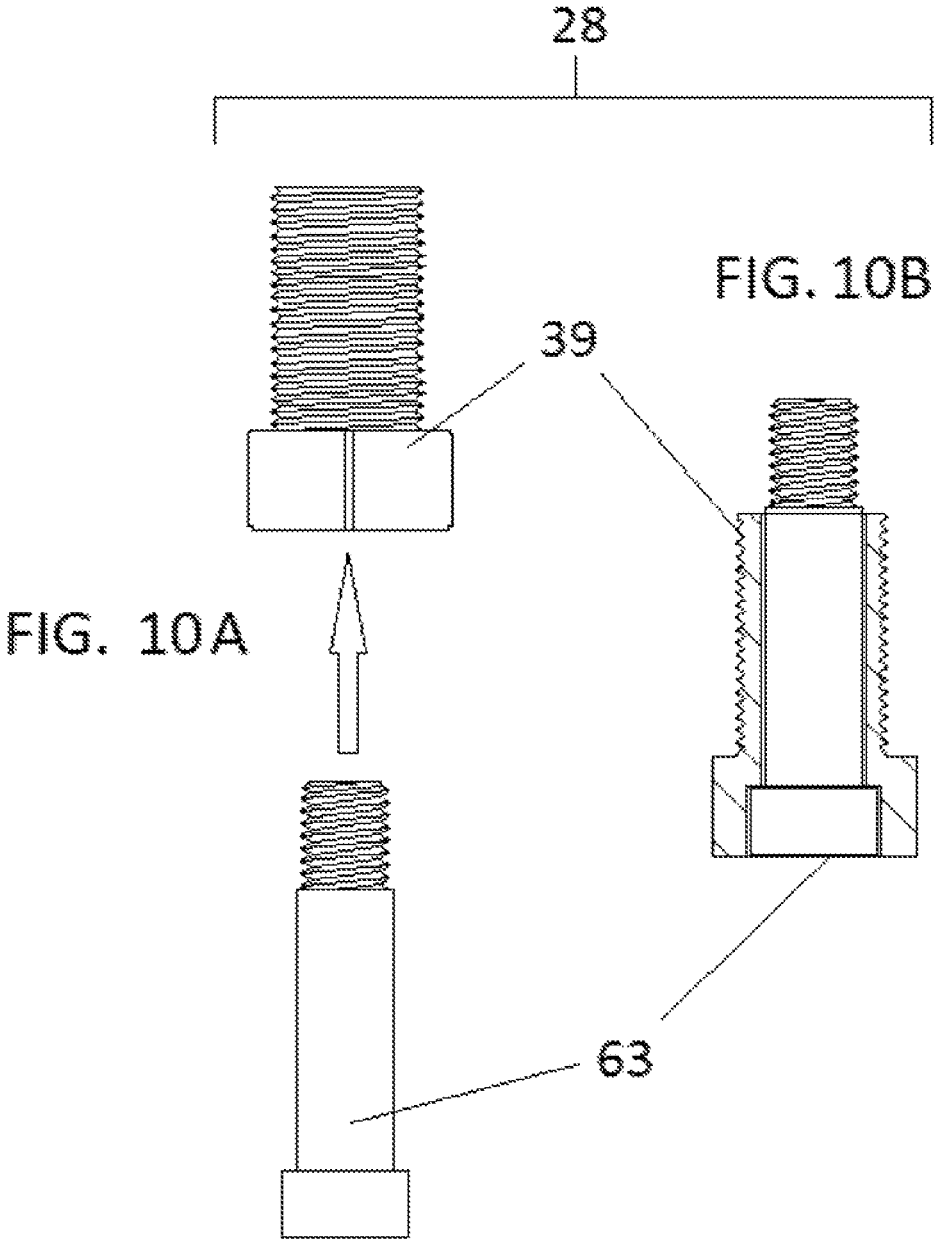
FIG. 10A is an exploded view of the elevator system which is made up of a hollow bolt and/or a solid bolt.
FIG. 10B is a cross sectional view of the elevator system which shows the inner bolt inserted through the center of the hollow bolt or hollow nut.

The Full Floater II drum shown assembled in FIG. 7 and exploded views in FIG. 1 and FIG. 8 are comprised of a framework in which the drum shell does not require any hardware to be bolted to it. In FIG. 8 the framework employs an edge ring or flange ring 26 or having both vertical and, horizontal surfaces, giving it an "L" cross section. The vertical walls of the flange ring 26 acts as a primary drum shell, and the horizontal wall acts as the anchor point for adjustable pull rods 68. The tuning system's cam ring 4 is attached to the flange ring 26 via adjustable elevators (FIG. 10 & FIG. 11) mentioned later in this application. A multiplicity of adjustable pull rods 68 are used to connect the edge ring to a second tuning system's cam ring 4 near the opposite open end of the drum shell 25. On the bottom, the drum shell 25 is slipped through the second tuning system's Cam Ring 4 surrounded by the Adjustable Pull Rods 68 until the shell contacts the underside of the flange ring 26. The use of the flange ring 26 separates the tuning system's (FIG. 1 reference character 1) mounted at opposite ends of the drum. This allows for independent tuning at both ends of the drum. Fully assembled, one end of the drum shell 25 butts up against the underside of die horizontal surface of the flange ring 26, the drum bead 23 stretched over the open end of the drum shell's 25 bearing edge 12 by the tuning system. On the top, a drum bead 23 is fitted over the bearing edge 12 of the flange ring 26, the Inner Hoop 2 is placed over the rim 24 of the drum head 23, and the Rotating Actuator 3 is placed over the Inner Hoop 2. Turning the Rotating Actuator engages the cam rollers (FIG. 2 reference character 59) into the Cam Ring 4 helical(s) or track(s) (FIGS. 3A & 3B reference character 37) while the rollers 58 connected to the vertical bosses 74 touch the Inner Hoop's 2 horizontal surface. Clockwise and/or counterclockwise movement of the Rotating Actuator 3 raises and/or lowers the pitch of the drum.

Figure 9:
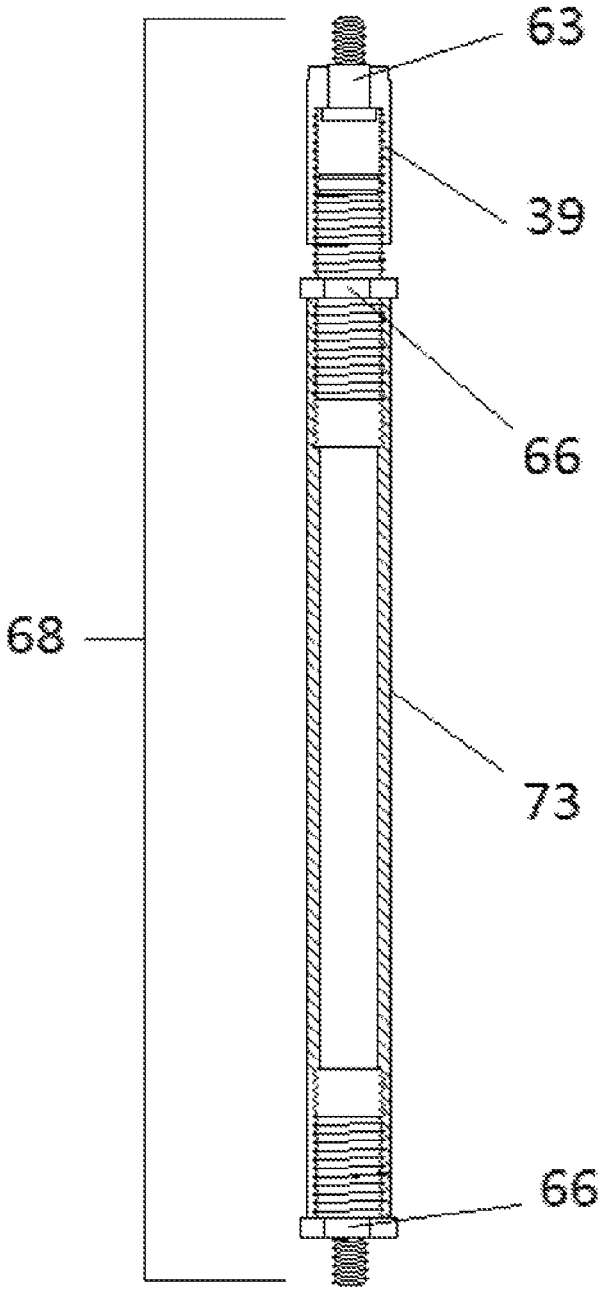
FIG. 9 is a cross sectional side view of the preferred embodiment of an adjustable pull rod.

The adjustable pull rods used with the Full Floater II framework are shown in FIG. 9. The pull rod 68 has a two sided male stud on one end 66, threaded into the rod 73, which can be hollow or solid. This end of the pull rod is firmly connected to one of the Cam Rings 4 or flange ring 26. The opposite end of the pull rod 68 also has a double ended male stud 66 threaded into the pull rod 73, and preferably immovably locked into place. A hollow tubular nut 39 which has a female threaded inside diameter and/or a through hole on one end is threaded onto the stud 66. A shoulder boll 63 is inserted through the female threaded side of the hollow nut 39 and is securely fastened to the Cam Rings (FIG. 1 reference character 4 or flange ring 26). Spinning of the multiple hollow tubular nuts 39 lengthens or shortens the pull rods 68, thereby adjusting the framework and Cam Ring 4 to ensure it is generally perpendicular to the edge of the drum shell 25 so that proper tuning can take place. This Would be done with all pull rods 68 on the drum until they are of approximately equal length and generally perpendicular to the drum shell's 25 bearing edge 12.

The preferred method of attachment of the cam operated "One Touch" drum tuning system 1, whether it be a full floating drum or a standard drum which has lugs (FIG. 12 reference character 45) attached directly to the drum shell, is herein described. To help ensure that the cam ring 4 of the tuning system 1 is set the correct distance from the open end of the drum's shell's bearing edge 12 there is preferably a requirement for adjustability. Several "Elevator" designs were devised and or tested thoroughly. One such Elevator system FIG. 10 used on both the Full Floater I and Full Floater II drums employs a tubular nut or hollow bolt 39 with external threads and has a hex or knurling on one end so it can be adjusted. In one embodiment, this method and apparatus resembles ins riling, a bolt through the hollow center of a larger bolt. A shoulder bolt 63 is inserted through the hollow of the tubular nut or hollow bolt 39 and securely attached to a Cam Ring 4 or flange ring 26 or 35. The tubular nut or hollow bolt 39 may have a recess for the head of the bolt 63, in part for aesthetics. Because the shoulder bolt 63 is fixed in place, simply spinning the tubular nuts or hollow bolts 39 clockwise or counterclockwise raises and/or lowers the Cam Ring 4 in relation to the open end of the drum shell's bearing edge 12 until the desired distance is achieved.

Another Elevator system embodiment used on both Full floater drums and/or Lug Mount drums is shown in FIG. 11 which uses a bolt or cap screw 29 which has a groove 30 cut into the shaft below the head of the bolt by the same distance as the thickness of the horizontal wall of the Cam Ring 4. A multiplicity of these Elevator bolts 29 are inserted through holes in the horizontal surface of the Cam Ring 4, and circlips 17 or optionally O-rings 52 are snapped into the grooves 30 in the bolts 29 to retain them. By spinning these Elevator bolts 29 clockwise or counterclockwise, the Cam Ring 4 is raised and/or lowered until the desired distance is set in relation to the open end of the drum shell's bearing edge 12.

There are literally millions of existing drum kits worldwide which could benefit from this cam operated one touch tuning system, therefore the ability to retrofit embodiments of this drum tuning system and apparatus 1 to any set of drums is advantageous. Several means for doing this were devised and tested on existing drums. The preferred embodiment in FIG. 12 shows a drum fitted with a cam operated tuning system which uses Elevator Bolts 29 that are installed through holes in the horizontal surface of the Cam Rings 4 and held in place by the circlips 17, and/or threaded directly into the drum's lugs 45. Upgrading the tuning system is easy; first the user must remove the standard drum hoop 22 and tension rods 67. The Cam Ring 4 of the one touch tuning system and apparatus 1 fitted with the Elevator Bolts 29 retained by circlips 17 is placed atop and aligned with the holes in the drum lugs 45 so that it encircles the drum's shell 25. Preferably one by one, each Elevator bolt 29 is tightened a few turns at a time until the height of the Cam Ring 4 is set the correct distance from the open end of the drum shell's bearing edge 12. A user should turn the bolts 29 only a few turns per pass so as not to bend and/or damage the Cam Ring 4. This is similar to installing a standard drum hoop 22, but preferably, a user only need to do this once for initially setting the Cam Rings 4 height. Following the tuning procedure previously mentioned, tune the drum to the desired pitch.

Due to quality control issues with some drum heads 23 or drum shell bearing edges 12, a micro-tuning system 4 shown in FIGS. 13A, 13B and 13C was devised to allow for adjusting the individual rim rollers 58 where the contact with the Inner Hoop 2. If there is a spot on the drum head 23 that is loose it may leave a small wrinkle and the pitch can be lower. If there is a high or low spot on the bearing edge 12 of the drum shell 25, it can cause improper stretching of the drum head 23 during tuning and/or create an uneven pitch. FIG. 13A shows the micro-tuner axle shaft 48 which employs an eccentric on the axle shaft, FIG. 13B is a front view depicting how the micro-tuner works. In one position, for example 12:00, the micro-tuner 48 would be in the neutral position. Rotating the micro-tuner eccentric axle 48 clockwise up to 90 degrees could lower the rim roller 58 onto the Inner Hoop and raise the pitch of the drum head at that location. By contrast, rotating, the micro-tuner eccentric axle 48 counterclockwise up to 90 degrees would raise the rim roller 58 and lower the pitch of the drum head 23 at that location. As the micro-tuner axle 48 is turned clockwise or counterclockwise. FIG. 13C illustrates how the rim, roller 58 connected to the Rotating Actuator ring 3 and cleat 5 would move up and/or down on the Inner Hoop 2 thereby changing the tension on the drum head. This fine tuning would be most beneficial to musicians doing studio work where everything must be perfect using imperfect components, such as a drum shell 25 or more often drum head 23. Quality drums can generally have very good bearing edges 12 which are perpendicular or "plum". Drum heads are mass produced, the skin generally being made of Mylar, so heat variances or human error can cause some heads (FIG. 1 reference character 23) not to be "plum" with the rim 24 of the drum head 23. Generally stretching a new drum head 23 resolves minor inconsistencies and allows for normal tuning.

Figure 14A:
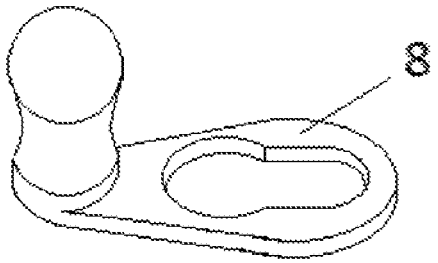
FIG. 14A is a 3D view of the preferred embodiment of the tuning tool which has a knob and or a keyhole on its flat surface.
Figure 14B:
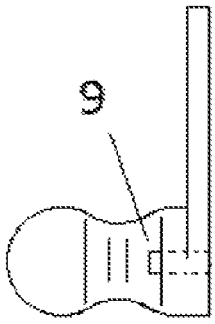
FIG. 14B is a side view of the tuning tool showing the radius cut out of the knob.
Figure 14C:
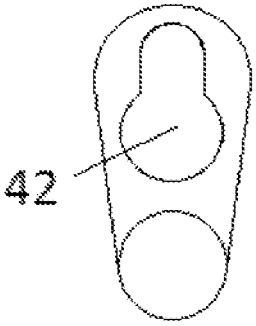
FIG. 14C is a top view of the tuning tool which shows the knob and/or the keyhole.

The NEW cleats 5 preferably also include a NEW tuning tool 11 shown in FIGS. 14A, 14B & 14C which has a keyhole 42 on its flat surface for engaging the cleat 5. Adjacent or near the keyhole is a knob 9 projecting outward from the flat surface 8 for use with hands or a drum stick as leverage to turn the Rotating Actuator 3 and/or tune the drum. The cleats (FIG. 13A, reference character 5) have a groove cut radially into the larger diameter wide enough to accept the wall thickness of the tuning tool. The keyhole 42 shape allows the larger hole of the tool to slide over the larger diameter of the cleat 5, the smaller diameter cut-out engages the smaller diameter groove on the cleat 5 when the user pulls on it, thereby locking it in place. The handle 9 has a radius cut into it to align the drum stick and/or provide better grip. Preferably, this tool pulls directly in the middle of the cleat and does not put a side load on the cleat and/or lessens side load on the vertical boss 74 on the Rotating Actuator ring 3. In addition, it is preferably small and fits in a drummer's pocket, and its simplicity makes it inexpensive to produce.

Figure 15:
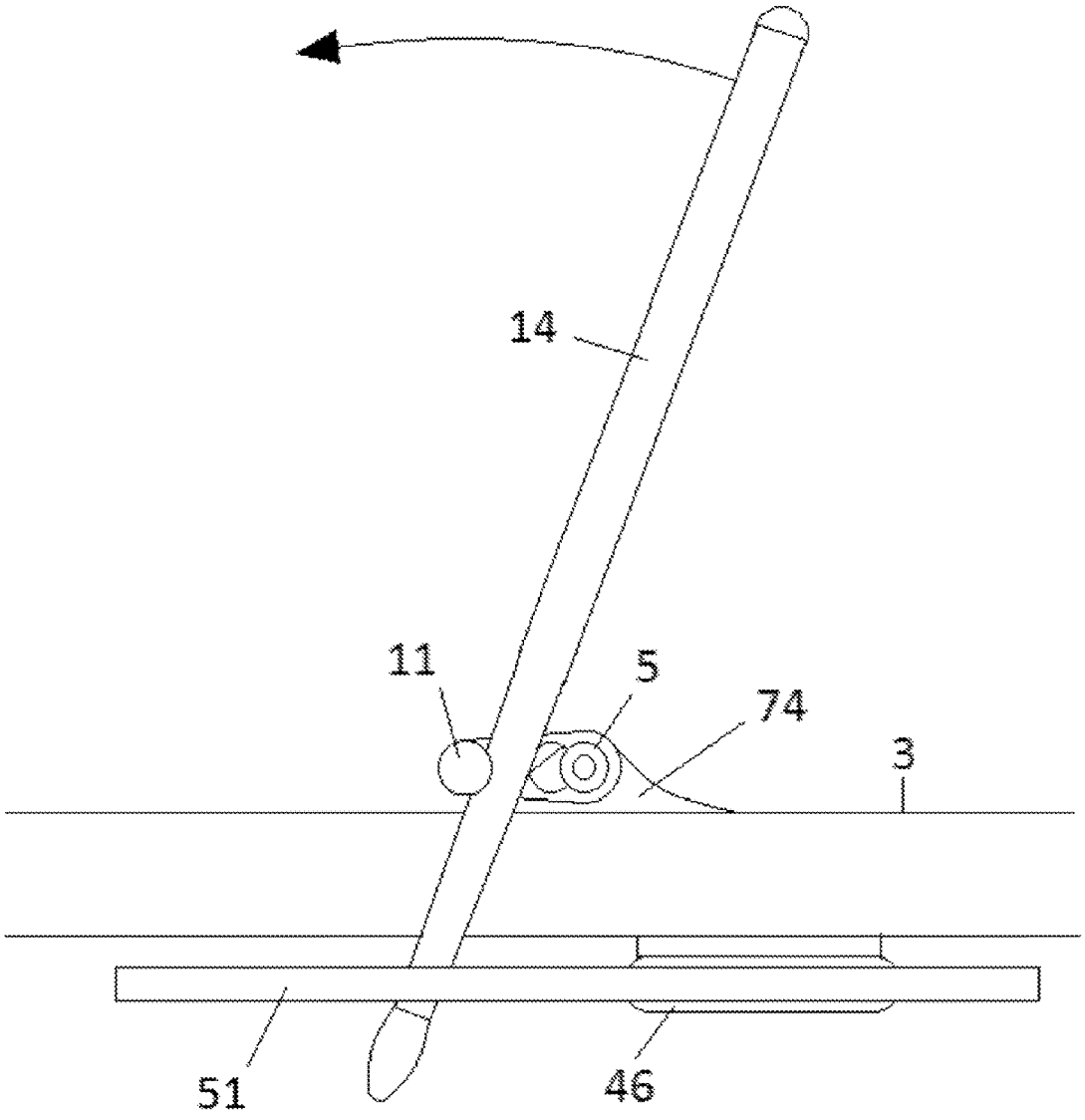
FIG. 15 is a drum stick being used as a lever with die tuning tool and/or the offset grip plate to turn the rotating actuator ring.

FIG. 15 illustrates how the Rotating Actuator is turned, drum stick 14 is being used as a lever pulling against the tuning tool 11 which is locked into the groove on the cleat 5 attached to the vertical boss 74 of the Rotating Actuator ring 3 while engaged with holes in the offset grip plate 51 which is plugged into the receiver 46.

Figure 16:
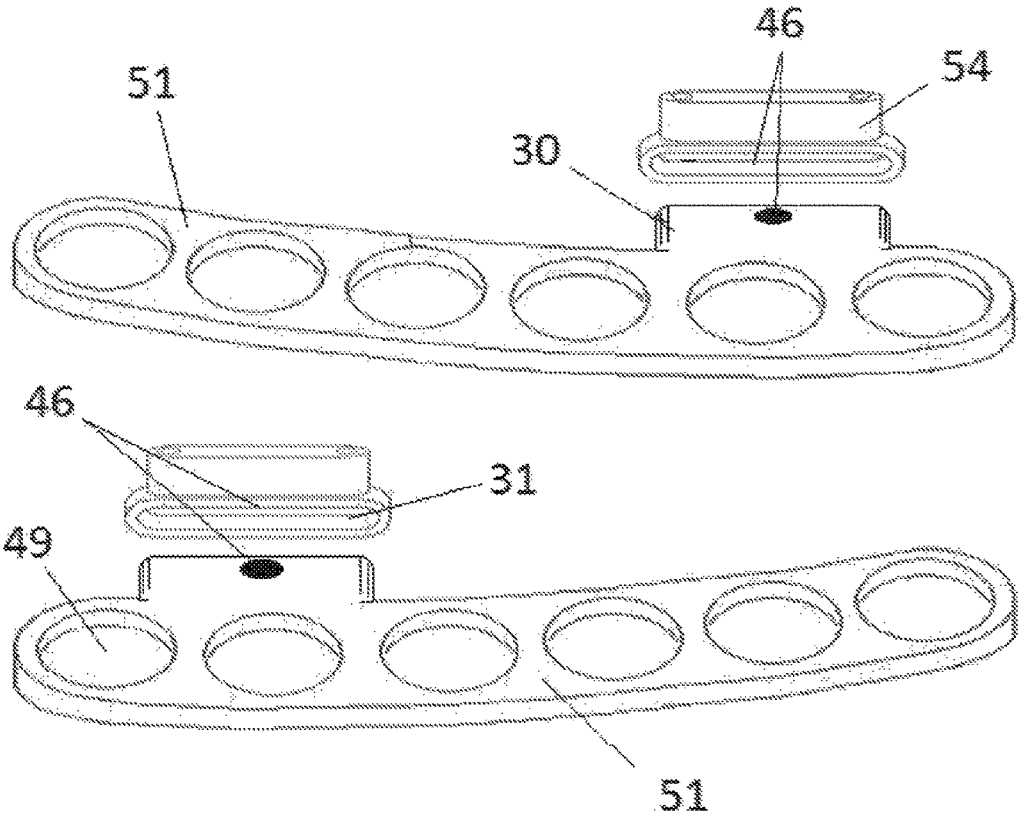
FIG. 16 is a 3D view of the preferred embodiment of the offset radius grip plate and/or receiver. The offset radius grip plate is shown flipped in both positions to illustrate the combined reach achieved by the offset.

A NEW offset radius grip plate FIG. 16 which is removable was introduced to reduce the number of radius grip plates necessary on a drum so that a single grip plate can be used to tune all of the drains in a kit. Because the NEW Rotating Actuator FIG. 2 reference character 3 employs a reduced number of cleats protruding from the vertical bosses 74 at its outer perimeter, it could have required a wider radius grip plate with more holes to cover a larger distance between them. To remedy that potential situation, the NEW offset radius grip plate FIG. 16 can be flipped over to cover the larger distance between the cleats 5. The radius grip plate 51 also has a protrusion 30 extending outward from the side, which engages a matching socket 31 in a receiver 54 attached to the Cam Ring 4 or flange rims 26 and 35. When tuning the drum using a drum stick as a lever, as the Rotating Actuator 3 is turned, a cleat 5 aligns with a hole or aperture 49 in the radius grip plate in a ratcheting motion. As the rotator 3 is moved, another bole 49 lines up. Eventually the plate runs out of holes and a cleat 5 is not close enough to continue tuning. By flipping the radius grip plate 51 over, more holes 49 are available for the drum stick to use as a leverage point. To keep the radius grip plate 51 from falling out of the receiver's 54 socket 31, magnets 46 could be employed to retain it during tuning.

In summary embodiments of the amine system can provide one or more of the following exemplary advantages: a system that is more rigid, accurate, simpler to use, and/or less expensive to manufacture due to the improvements made to the NEW Rotating Actuator ring 3 described herein. There is also n ore tuning range with the NEW multiple helical Cam Ring 4 and the Inner Hoop 2. The NEW tuning tool 11 is easier to use due in part to the keyhole 42 and the handle with the radius 9 cut into it. The NEW radius grip plate 51 which is both removable and can be flipped over is more compact and lowers the cost of the system to the drummer due to less parts being attached to each drum. Retrofitability and adjustability have been enhanced with, inter alia, the addition of elevator systems 28. The ability to fine tune the drum has been enhanced with the addition of a micro-tuning axle 48 added to the Rotating Actuator ring 3. Full floating drums which are known to exhibit excellent sound quality and resonance. By incorporating adjustable pull rods 68 and/or non-adjustable pull rods 10, elevators 28 and or full floater flange rings 26 & 35, the one touch tuning systems can be mounted on these types of drums.

While the preferred embodiments of the invention have been illustrated and described, as noted above, many changes can be made without departing from the spirit and scope of the invention. For example, several of the described embodiments can be used alone or in combination with several of the other alternate embodiments described. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A drum tuning system and apparatus comprising:

an actuator ring system comprising three overlapping annular members, including a rotating actuator ring, an inner hoop and a cam ring having a multiplicity of leads, the actuator ring member to adjust the pitch of a musical drum when fitted near the open end of a drum shell;

said rotating actuator ring being the largest in diameter of the three annular members and rotatable about the other two ring members to facilitate a camming action and having a cross section profile having a thicker mid-section tapering smaller at the top and the bottom;

a multiplicity of evenly spaced vertical bosses projecting upward along the horizontal surface near its mid-section;

said vertical bosses wider and thicker at the base tapering down smaller on the top and having holes for accepting inward facing rim rollers and axles;

said rotating actuators lower tapered vertical wall having holes for accepting inward facing cam rollers and axles;

wherein rotating movement of said rotating actuator ring simultaneously cause said rim rollers to bear down on an inner hoop while at least some of said cam rollers initially engage the cam ring to draw the inner hoop and cam ring closer together or move them further apart; and wherein said camming action alters the tension on the drum head when fitted over the open end of a drum shell thereby tuning the drum.

2. The tuning system and apparatus according to claim 1 used as part of the tuning system comprised of three overlapping annular members to adjust the pitch of a musical drum when fitted near the open end of a drum shell, including the inner hoop, wherein;

said inner hoop having an L cross section to form a flange;

said inner hoop's vertical wall projecting upward and the horizontal wall projecting outward;

said inner hoop smaller in diameter than the inside diameter of the first rotating actuator ring member;

said inner hoop having a radial lip projecting downward below the axis of the vertical and horizontal walls;

said inner hoop positioned over the top of the drum head and cam ring; said projection bares down on the rim of a drum head;

the outside diameter of said projection can overlap the inside diameter of the cam ring.

3. The tuning system and apparatus according to claim 1 for fine adjusting the height of the inward facing rim rollers attached to axles fitted into the multiplicity of vertical bosses on the rotating actuator ring;

said axle shaft being an eccentric which when rotated raises and lowers the rim roller in relation to the rotating actuator;

said axle shaft's neutral position being at 0 degrees, up to 90 degrees one direction lowers the roller, up to 90 degrees the other direction raises the roller;

said rollers riding on the horizontal surface of the inner hoop which tensions the drum head;

fine tuning accomplished by changing the pressure of each individual rim roller on the horizontal surface of the inner hoop.

4. The tuning system and apparatus according to claim 1 further comprising a tool for grasping the rotating actuator ring at the multiplicity of cleats which protrude outward from the vertical bosses on the rotating actuator ring; said cleats having a groove cut into it to accept said tool; said tool having a keyhole on its horizontal surface and a knob protruding outwardly from the horizontal surface next to said keyhole; said knob having a radius cut into it for alignment purposes for a drum stick or fingers for grip; said keyhole's larger diameter fitting over the outside diameter of the cleat; said keyhole's smaller diameter fitting into the groove cut into said cleat; pulling on said knob locks said keyhole into the groove on the cleat; said tool used as a lever to pull the rotating actuator rotating to facilitate the camming action to tune the drum.

5. The tuning system and apparatus according to claim 4 further comprising a removable radius grip plate for use with the tool included in claim 4 having multiple holes in its horizontal surface;

said multiple holes to be used as a fulcrum for a drum stick or fingers;

said radius grip plate having an inner radius and an outer radius;

said radius grip plate having an offset protrusion from the horizontal surface on its inner radius to engage a receiver attached to the cam ring, or flange ring;

flipping said radius grip plate over effectively moves the offset protrusion to the opposite end thereby offering more lever points for a finger or drum stick.

6. The tuning system and apparatus according to claim 5, having said removable radius grip plate which employs a magnet for retaining it when inserted into the retainer attached to the cam ring, or flange ring.

7. A tuning system and apparatus comprising a cam ring used as part of a tuning system comprised of three overlapping annular members to adjust the pitch of a musical drum when fitted near the open end of a drum shell;

the outside diameter of said cam ring smaller in diameter than the inside diameter of a rotating actuator ring;

said cam ring having a multiplicity of helical tracks about the vertical wall of its outer circumference beginning at the top and exiting at the bottom;

inward facing cam rollers attached to the lower vertical wall of the rotating actuator ring;

a multiplicity of leads about the vertical wall of the cam ring adjacent the helical tracks for simultaneously engaging at least some of the cam rollers;

said tracks providing for ramped cam surfaces; rotating movement of said rotating actuator ring about said cam ring and inner hoop draw the inner hoop and cam ring closer together or move them further apart;

said camming action alters the tension on the drum head when fitted over the open end of a drum shell thereby tuning the drum.

8. A full floating framework for adjusting the pitch of the drum without any hardware bolted the drum shell;

said framework comprised of a rotation actuated drum tuning system comprising a rotating actuator ring engaging a cam ring about the upper drum hoop and drum head, an intermediate annular member, and a multiplicity of pull rods;

said annular member having a multiplicity of evenly spaced holes to attach said tuning system and downward extending pull rods;

said pull rods being shorter than the length of the drums shell; said framework used to sandwich a drum shell between its opposite ends;

said pull rods used to connect a an annular member to retain the lower drum head and drum shell.

9. A full floating framework according to claim 8 employing a standard drum hoop, comprising a flange ring connected to the pull rods;

the flange ring and pull rods surround the drum shell;

wherein rotating said actuator ring about said cam ring simultaneously tensions both drum heads fitted over the open ends of the drum shell.

10. A full floating framework according to claim 8 comprised further of a rotation actuated drum tuning system comprising, a flanged annular member having an L cross section having both a vertical and horizontal walls, a multiplicity of pull rods, and a second drum tuning and tensioning system on the bottom;

said flanged annular member having a multiplicity of evenly spaced holes to attach said tuning system and pull rods;

said pull rods being shorter than the length of the drums shell;

said pull rods connecting the second drum tuning system to the flange ring;

said flange ring's vertical wall of the L cross section doubling as a drum shell for the upper tuning system;

the underside of said flange ring used to sandwich a drum shell between one open end of the framework on the bottom;

wherein rotating either of said drum tuning system's rotating actuator rings rotating independently tensions the drum heads fitted over the open end of the drum shell.

11. A full floating framework according to claim 10 using adjustable pull rods;

said adjustable pull rod being hollow or solid having male threads on both ends; one end having a tubular nut which spins on the male thread;

said tubular nut retained by a shoulder bolt inserted through its inside diameter and threaded into the flange ring;

rotating rotation of said tubular nut extends or shortens the overall length of the adjustable pull rod.

12. The full floating framework according to claim 10 comprising an elevator mechanism used to attach the rotation actuated drum tuning system to the full floating framework's flange rings;

said elevator mechanism having two parts, a long hollow nut with external threads, and a shoulder bolt;

said hollow nut having a hex or knurled end for adjustment;

said hollow nut threaded into the flange ring;

a cam ring;

said shoulder bolt threaded into the cam ring of the rotation actuated tuning system;

a multiplicity of said hollow nuts threaded into said flange ring;

said shoulder bolt threaded into the cam ring of said rotation activated drum tuning system;

turning the multiplicity of said hollow nuts rotating raises or lowers the cam ring of said rotation actuated tuning system in order to align it perpendicular to the bearing edge of the drum's shell.

13. The full floating framework according to claim 12 regarding the elevator bolt used to attach the cam ring from the rotation actuated drum tuning system to the flange of the Full Floating framework or standard lugs attached to a drums shell;

said elevator bolt being a cap screw or bolt having a groove cut into the shaft below the head of the bolt;

said groove to accept a circlip or O-ring to retain the bolt once inserted through holes in the rotating actuated tuning system's cam ring;

said elevator bolt threaded into a lug bolted to the drum's shell, or said full floating framework flange;

turning said elevator bolt rotating raises and lowers the cam ring of said rotation activated tuning system in order to align it perpendicular to the bearing edge of the drum's shell.

* * * * *